United States Patent [19]

Fischer et al.

[11] 4,131,470

[45] Dec. 26, 1978

[54] PROCESS FOR THE STABILIZATION AND ANTIFOGGING OF PHOTOGRAPHIC SILVER HALIDE EMULSIONS

[75] Inventors: Günther Fischer, Leipzig; Beate Wenzel, Dessau-Süd; Steffen Scheithauer, Dessau; Udo Franz, Dresden; Karl-Wilhelm Jünge, Dessau; Christof Schröter, Leipzig; Siegfried Gahler, Wolfen; Johannes Morgenstern, Pirna-Copitz, all of Germany

[73] Assignee: VEB Filmfabrik Wolfen, Wolfen, Fed. Rep. of Germany

[21] Appl. No.: 753,145

[22] Filed: Dec. 21, 1976

[51] Int. Cl.[2] ..... G03C 1/28; G03C 1/34

[52] U.S. Cl. ..... 96/107; 96/108; 96/109

[58] Field of Search ..... 96/109, 107, 108

[56] References Cited

U.S. PATENT DOCUMENTS

| | | | |
|---|---|---|---|
| 3,311,474 | 3/1967 | Willems et al. | 96/109 |
| 3,365,294 | 1/1968 | von Konig | 96/109 |
| 3,824,103 | 7/1974 | Pierce et al. | 96/109 |

OTHER PUBLICATIONS

Chem. Abs., vol. 86, 1977, 49316x.

*Primary Examiner*—Won H. Louie, Jr.
*Attorney, Agent, or Firm*—Nolte & Nolte

[57] ABSTRACT

A process for the stabilization of and the prevention or substantial reduction of fogging in the use of photographic silver halide emulsions, characterized in that compounds selected from the group consisting of those represented by the general formulas I, II, and III:

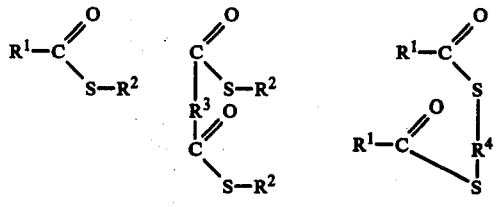

I II III are added to the emulsion, before or during chemical sensitization and before coating of the emulsions onto a support therefor, wherein $R^1$, $R^2$, $R^3$ and $R^4$ are as herein described.

7 Claims, No Drawings

PROCESS FOR THE STABILIZATION AND ANTIFOGGING OF PHOTOGRAPHIC SILVER HALIDE EMULSIONS

BACKGROUND OF THE INVENTION (1) Field of the Invention

The invention relates to a process for the stabilization of and the prevention or substantial reduction of fogging in the use of photographic silver halide emulsions during the stages of their production.

(2) Description of the Prior Art

It is well-known in the art, that apart from the appearance of the silver image in developing exposed silver halide emulsion layers, there also occurs an additional darkening, called "fog." Fogging is dependent upon the properties of the emulsion and its additives as well as upon the conditions of storage and development. To prevent or to reduce fogging, stabilizers and anti-fogging agents are added to the emulsion or to the developer, usually resulting in a loss in sensitivity. An exception is the compound 5-methyl-7-hydroxy-1,3,4-triazaindolizine (hereinafter designated as "triazaindolizine"), which shows a distinct sensitizing effect aside from its good stabilizing properties. This compound, however, is not sufficiently effective against all sources of fogging. Furthermore, numerous mercapto-substituted heterocyclic compounds with good anti-fogging effects are known (e.g., 1-phenyl-5-triotetrazole). By combining these compounds with triazaindolizine, it is possible to partly compensate for their simultaneously existing tendency to desensitize. Moreover, their photographic activity may be weakened in that the mercapto group is substituted by a group which is easily cleavable. "Masked anti-fogging agents" of such kind having a sufficient stability before storing or developing usually have less of a desensitizing effect than their starting compounds. The S-acylation of mercapto compounds under formation of thiolesters may be understood as a "masking process" of such a type. S-acyl derivatives of heterocyclic mercapto compounds have already been described as anti-fogging agents (DDR Patent No. 1,173,336). However, by this latter disclosure, it is not possible to completely prevent the above-mentioned disadvantage of desensitization.

SUMMARY OF THE INVENTION

It is, therefore, among one of the principal objectives of the present invention to provide a process of stabilizing photographic silver halide materials without any loss in sensitivity.

It is a further object of this invention to effect such stabilization as well as anti-fogging without loss in sensitivity.

This invention accordingly contemplates adding to silver halide emulsions, compounds selected from the group consisting of those represented by the general formulas I, II and III:

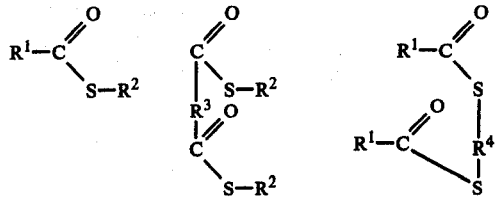

I II III wherein $R^1$ stands for alkyl, alkenyl, cycloalkyl or aralkyl, either unsubstituted or singly or in multiples substituted by halogen, hydroxy, alcoxy, acyloxy, carboxy, alcoxycarbonyl, and cyano;

or aryl, either unsubstituted or singly or in multiples substituted by halogen, hydroxy, alcoxy, acyloxy, carboxy, alcoxycarbonyl, cyano, alkyl, cycloalkyl, aryl, amino, nitro, and sulfo;

or heterocyclyl, either unsubstituted or singly or in multiples substituted by halogen, hydroxy, alcoxy, acyloxy, carboxy, alcoxycarbonyl, cyano, alkyl, cycloalkyl, aryl, and amino;

$R^2$ stands for alkyl, alkenyl, or aralkyl, either unsubstituted or singly or in multiples substituted by halogen, hydroxy, carboxy, and cyano;

or aryl, either unsubstituted or singly or in multiples substituted by halogen, hydroxy, alcoxy, acyloxy, carboxy, alcoxycarbonyl, carbonamido, cyano, alkyl, cycloalkyl, aryl, amino, acylamino, nitro, and sulfo;

or heterocyclylalkyl, either unsubstituted or substituted;

$R^3$ has the meanings given under $R^1$, but being divalent;

$R^4$ has the meanings given under $R^2$, but being divalent.

A specific advantage of this invention is, that the disclosed compounds when added to the silver halide emulsion, are excellent anti-fogging agents, superior in effect to the above-identified heterocyclic thiolesters. This effect is surprising and not to be foreseen, because the mercaptans and thiophenols liberated by hydrolysis are generally less effective as anti-fogging agents than their heterocyclic analogues.

DESCRIPTION OF THE PREFERRED EMBODIMENTS

When added to the emulsion or to any auxiliary layer desired, in accordance with the invention, the selected compounds result in improved anti-fogging effects while maintaining the same sensitivity as that maintained by using known anti-fogging agents. The addition of the selected compounds may be performed in any stage of the preparation of the emulsion, preferably before or during chemical ripening and before coating the emulsion.

An advantage of the invention consists in being able to use the selected compounds or anti-fogging agents together with other stabilizers and anti-fogging agents. What is particularly preferred is their application as supplementary anti-fogging agents in addition to the basic triazaindolizine stabilizer. In this combination, the proportion of sensitivity to fog is more favorable than the sole use of triazaindolizine.

Furthermore, it is advantageous, that the present selected anti-fogging agents may be added to emulsions previously sensitized by gold or sulphur compounds or reducing agents. They are adequate to suppress undesired fogging frequently caused by sulphur-based sensitizers in which the fog may be effected by the sensitizing ingredients of the gelatin itself (in the case of so-called "active" gelatins) or by the sulphur-based sensitizers which have been added to a gelatin "free of foreign substances" (so-called). The selected compounds may be used in the presence of spectral sensitizers, hardeners, wetting agents and other photochemical additives, as well. The quantity of the selected compounds may range between about 0.005 and 5, preferably between about 0.05 and 1, m mols per one mol of silver halide.

The selected compounds may be synthesized by known methods, e.g., by alkylation of thiocarboxylic acids, by acylation of mercapto compounds (with the aid of anhydrides of carboxylic acids, phenylesters, chlorides of carboxylic acids, or mixed anhydrides of carboxylic and carbonic acids) or by hydrolysis of iminothioethers, as described in "Houben-Weyl, *Methoden der organischen Chemie,*" 4th ed., vol. 9, p. 749–756 (1955). Furthermore, they may be prepared by reducing sulfochlorides or disulfides with phosphorus and iodine in the presence of carboxylic acids. (J. Morgenstern and R. Mayer, Zeitschrift fur Chemie, 10, 449 (1970); J. Morgenstern, D. Kunz and R. Mayer, Pharmazie, 24, 450 (1969); J. Morgenstern and R. Mayer, DDR - Patent No. 67,419, filed April 4, 1968).

The invention will be illustrated by the following specific examples to which, it is understood, the invention is not limited.

In the examples and the appended tables the known control compounds (IV–VI) and the selected compounds used according to the invention (VII–XIV) are defined as follows:

IV = 2-(acetylthio)-benzoxazole
V = 1-phenyl-5-(benzoylthio)-tetrazole
VI = 3-methyl-4-phenyl-5-(benzoylthio)-1,2,4-triazole
VII = benzyl p-nitrothiolbenzoate
VIII = phenyl thiolbenzoate
IX = p-n-hexylphenyl thiol-γ-naphthoate
X = benzyl thiolphenylacetate
XI = p-cyanphenyl thiolbenzoate
XII = p-acetylaminophenyl thiolacetate
XIII = p-methoxyphenyl p-hydroxythiolbenzoate
XIV = benzyl thiolpropionate.

EXAMPLE 1

A high-sensitivity gelatino-silver, bromoiodide boiling emulsion in which active gelatin is used, was chemically sensitized by gold compounds and polyethyleneoxides and was spectrally sensitized by cyanine dyes in a conventional manner, followed by division into five parts. To one sample, as a standard, only triazaindolizine (10 m mols per one mol of silver halide) and the other usual additives were added. To the remaining samples, there were added the compounds IV, V, VII, and VIII respectively, in the quantities given in Table 1 below. The pH of the mixture was 7.0.

The samples of the emulsion were coated onto a support and the resulting photomaterials were cut into strips, which were exposed, in the fresh state, for seven days at 50° C. and 60–70% relative humidity, and for ten days at 50° C., using a sensitometer disposed behind a daylight filter and a step wedge having a coefficient of $\sqrt{2}$. The strips were then developed in a developer of the following composition:

| | |
|---|---|
| metol | 1.5 g |
| $Na_2SO_3$ | 18.0 g |
| hydroquinone | 2.5 g |
| $K_2CO_3$ | 18.0 g |
| KBr | 1.0 g |
| water to make | 1.0 l |

Developing was followed by conventional fixation, watering, and drying. In Table 1, the sensitometric data (relative sensitivity at a density of 0.1 over the fog; change in fogging in comparison to the standard) are summarized.

It is to be seen, that both the fresh and stored samples to which the selected compounds (VII, VIII) were added, exhibited better sensitivity and, to a certain extent, better anti-fogging compared with the standard. While the control compounds (IV, V) exhibited anti-fogging effects, sensitivity was very adversely affected.

EXAMPLE II

A high-sensitivity ammoniacal gelatino-silver bromoiodide emulsion, in which active gelatin is used, was sensitized by the manner of Example 1 and triazaindolizine (4 m mols per one mol of silver halide) and the other conventionally used additives were added. The sample being used as a standard excepted, the quantities of the compounds VII–X given in Table 2 were added to all the other parts. The methods of coating, cutting, and storing were the same as described in Example 1. Exposure was effected using a sensitometer disposed behind a blue filter and a step wedge. The data given in Table 2 were obtained after processing and evaluation (cf. Example 1).

The improved stabilizing effect of the selected compounds used according to the invention as compared to the standard can be particularly observed in that better anti-fogging and better sensitivity is exhibited relative to the standard.

EXAMPLE III

A gelatino-silver chlorobromide boiling emulsion having a proportion of 15 Mol % of AgBr and a content of 0.37 mols of silver halide per one kg of emulsion, prepared from a "free of foreign substances" gelatin is divided into ten parts before the beginning of the chemical ripening. As chemical sensitizers, there are added successively — per each mol of silver halide — 15 ml of an aurous rhodanide solution (0.4 mg Au per ml) and 0.015 m mols of methyl p-dimethylaminodithiobenzoate as well as, with the exception of the non-stabilized sample 1 used as a standard, 0.6 m mols of the thiolesters VI—XIV with anti-fogging effect, respectively, shown in Table 3.

After a ripening time of 2 hours at 44° C., the emulsion samples are coated onto a support, cut into strips, exposed for 10 seconds with about 115 Lx behind a frosted-glass filter and a step wedge having a coefficient of $\sqrt{2}$ and are developed for four minutes at 20° C. in a developer of the following composition:

| | |
|---|---|
| lime preservative | 2.0 g |
| metol | 3.5 g |
| $Na_2SO_3$ | 60.0 g |
| hydroquinone | 9.0 g |
| $Na_2CO_3$ | 40.0 g |

-continued

| | |
|---|---|
| KBr | 3.5 g |
| water to make | 1.0 l |

Developing was followed by conventional fixation, watering, and drying. The sensitometric data (relative sensitivity at a density of 0.1 and 1.0 over the fog; change in fogging compared with the standard) are given in Table 3.

It is to be seen, that the fog value is diminished considerably throughout all substances in relation to the standard (about 0.40). Furthermore, while it is observed in the sample in which the known compound VI, however, was used, strong desensitivity is exhibited, no loss in sensitivity, or an insignificant reduction not exceeding the maximum of a half step, can be observed in the samples in which the compounds VII–XIV were used.

EXAMPLE IV

A high-sensitivity gelatino-silver bromoiodide boiling emulsion having a proportion of 3.6 mol % of AgI and a content of 0.28 mols of silver halide per one kg of emulsion, which was prepared with a "free of foreign substances" gelatin, is divided into six parts before the beginning of the chemical ripening. As chemical sensitizers, there are added — per each mol of silver halide — 12 ml of an aurous rhodanide solution (0.4mg Au per mol) and 0.3 m mols of methyl p-dimethylaminodithiobenzoate, as well as, with the exception of the standard sample 1, 0.3 m mols of the anti-fogging thiolesters IV, VI, VIII, IX and XIV, respectively, shown in Table 4. After a ripening time of two hours at 54° C., the emulsions were coated onto a support, are cut into strips, were exposed for eight seconds and about 115 Lx behind a frosted-glass filter and a step wedge with a coefficient of $\sqrt{2}$, and were developed for four minutes at 20° C. in the developer of the composition set forth in Example 1. After conventional fixation, watering, and drying, the data given in Table 4 were obtained.

Again it is to be seen, that the tested substances have a strong fog diminishing effect in comparison to the standard. Furthermore, the known compounds IV and VI desensitize considerably, while sensitivity in the presence of the selected compounds VIII and IX was not influenced and even increased in the case of compound XIV.

Table 1

| sample | addition, compounds IV - VIII (m Mol per Mol Ag hal) | fresh rel. $S_{0.1}$ | fresh Δ fog | after 10 days at 50° C rel. $S_{0.1}$ | after 10 days at 50° C Δ fog | after 7 days at 50° C, rel. humidity 65% rel. $S_{0.1}$ | after 7 days at 50° C, rel. humidity 65% Δ fog |
|---|---|---|---|---|---|---|---|
| 1 | — (standard) | 100 | 0 | 47 | + 0.04 | 47 | + 0.07 |
| 2 | IV (0.3) | 71 | 0 | 31 | 0 | 7 | − 0.04 |
| 3 | V (0.3) | 25 | − 0.04 | <6 | − 0.06 | — | — |
| 4 | VII (0.03) | 141 | − 0.02 | 54 | + 0.02 | 54 | + 0.04 |
| 5 | VIII (0.03) | 123 | 0 | 71 | − 0.02 | 58 | + 0.04 |

Table 2

| sample | addition, compounds VII - X (m Mol per Mol Ag hal) | fresh rel. $S_{0.1}$ | fresh Δ fog | after 10 days at 50° C rel. $S_{0.1}$ | after 10 days at 50° C Δ fog | after 7 days at 50° C, rel. humidity 65% rel. $S_{0.1}$ | after 7 days at 50° C, rel. humidity 65% Δ fog |
|---|---|---|---|---|---|---|---|
| 1 | — (standard) | 100 | 0 | 76 | + 0.05 | 44 | + 0.10 |
| 2 | VII (0.075) | 100 | 0 | 93 | + 0.03 | 41 | + 0.04 |
| 3 | VIII (0.075) | 87 | − 0.02 | 76 | 0 | 71 | + 0.04 |
| 4 | IX (0.075) | 123 | 0 | 93 | + 0.03 | 58 | + 0.04 |

Table 2-continued

| sample | addition, compounds VII - X (m Mol per Mol Ag hal) | fresh rel. $S_{0.1}$ | fresh Δ fog | after 10 days at 50° C rel. $S_{0.1}$ | after 10 days at 50° C Δ fog | after 7 days at 50° C, rel. humidity 65% rel. $S_{0.1}$ | after 7 days at 50° C, rel. humidity 65% Δ fog |
|---|---|---|---|---|---|---|---|
| 5 | X (0.075) | 100 | 0 | 81 | + 0.03 | 50 | + 0.05 |

Table 3

| sample | addition, compounds VI - XIV (0.6 m Mol per mol Ag hal) | rel.$S_{0.1}$ | rel.$S_{0.1}$ | Δ fog |
|---|---|---|---|---|
| 1 | — (standard) | 100 | 100 | 0 |
| 2 | VI | 35 | 31 | − 0.30 |
| 3 | VII | 87 | 93 | − 0.30 |
| 4 | VIII | 71 | 81 | − 0.18 |
| 5 | IX | 76 | 87 | − 0.10 |
| 6 | X | 87 | 115 | − 0.19 |
| 7 | XI | 107 | 100 | − 0.06 |
| 8 | XII | 107 | 100 | − 0.10 |
| 9 | XIII | 87 | 71 | − 0.18 |
| 10 | XIV | 76 | 132 | − 0.32 |

Table 4

| sample | addition, compounds IV - XIV (0.3 m Mol per Mol Ag hal) | rel.$S_{0.1}$ | Δ fog |
|---|---|---|---|
| 1 | — (standard) | 100 | 0 |
| 2 | IV | 35 | − 0.05 |
| 3 | VI | 35 | − 0.40 |
| 4 | VIII | 100 | − 0.12 |
| 5 | IX | 100 | − 0.07 |
| 6 | XIV | 141 | − 0.06 |

What we claim is:

1. A process for the stabilization and anti-fogging of a photographic silver halide emulsion including chemical sensitization and coating of said emulsions onto a support, characterized in that a stabilizing and anti-fogging amount of at least one compound represented by the general formula:

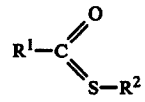

is added to said emulsion, wherein $R^1$ represents a member selected from the group consisting of alkyl, alkenyl, cycloalkyl and aralkyl, either unsubstituted or substituted by one or multiple substituents selected from the group consisting of halogen, hydroxy, alcoxy, acyloxy, carboxy, alcoxycarbonyl and cyano;

or an aryl selected from the group consisting of phenyl and napthyl, either unsubsituted or substituted by one or multiple substituents selected from the group consisting of halogen, hydroxy, alcoxy, acyloxy, carboxy, alcoxycarbonyl, cyano, alkyl, cycloclkyl phenyl, napthyl, amino, nitro and sulfo;

$R^2$ represents a member selected from the group consisting of alkyl, alkenyl and aralkyl, either unsubstituted or substituted by one or multiple substituents selected from the group consisting of halogen, hydroxy, carboxy, and cyano; or an aryl selected from the group consisting of phenyl and napthyl, either unsubstituted or substituted by one or multiple substituents selected from the group consisting of halogen, hydroxy, alcoxy, acyloxy, carboxy, alcoxycarbonyl, carbonamido, cyano, alkyl, cycloalkyl, aryl, amino, acylamino, nitro and sulfo.

2. A process according to claim 1 in which addition of said compound takes place before chemical sensitization and before coating of said emulsion.

3. A process according to claim 1 in which as sensitizers gold or sulphur compounds are added to said emulsions.

4. A process according to claim 1 in which said emulsion is prepared with active gelatin.

5. A process according to claim 1 in which said compound is added in quantities between about 0.005 and 5 m mols per one mol of silver halide.

6. A process according to claim 1 in which said compounds are added in quantities between 0.05 and 1 m mol.

7. A process according to claim 1 in which the addition of said compound takes place during chemical sensitization and before coating of said emulsion.

* * * * *

UNITED STATES PATENT AND TRADEMARK OFFICE

CERTIFICATE OF CORRECTION

PATENT NO. : 4,131,470

DATED : December 26, 1978

INVENTOR(S) : Gunter Fischer et al

It is certified that error appears in the above–identified patent and that said Letters Patent are hereby corrected as shown below:

[73] Assignee: VEB Filmfabrik Wolfen, Wolfen

German Democratic Republic

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*